US006647215B1

(12) United States Patent
Ogle et al.

(10) Patent No.: US 6,647,215 B1
(45) Date of Patent: Nov. 11, 2003

(54) SYSTEM AND METHOD FOR DETECTING PRESENCE OF A SHIPPING INSERT OF A PRINTING DEVICE

(75) Inventors: Angela Kay Ogle, Boise, ID (US); Cori Schaefer, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 39 days.

(21) Appl. No.: 10/191,267

(22) Filed: Jul. 8, 2002

(51) Int. Cl.[7] ..... G03G 15/20; G03G 15/00
(52) U.S. Cl. ..... 399/13; 399/21; 399/122
(58) Field of Search ..... 399/9, 13, 21, 399/24, 33, 43, 67, 110, 122, 124; 347/156

(56) References Cited

U.S. PATENT DOCUMENTS 5,579,097 A * 11/1996 Tomoe et al. ..... 399/323
5,956,547 A * 9/1999 Kamei et al. ..... 399/122
6,539,185 B2 * 3/2003 Hanyu et al. ..... 399/67

FOREIGN PATENT DOCUMENTS

JP 07-175360 * 7/1995

* cited by examiner

*Primary Examiner*—Sophia S. Chen

(57) ABSTRACT

The present disclosure relates to a system and method for detecting the presence of a shipping insert in a printing device. In one arrangement, the system and method pertain to determining if a print medium is detected at a fusing system exit of the printing device, and if a print medium is detected at the fusing system exit of the printing device, determining if a page count of the printing device is equal to zero, wherein if the page count is equal to zero it is confirmed that a shipping insert is present in the printing device.

20 Claims, 8 Drawing Sheets

SYSTEM AND METHOD FOR DETECTING PRESENCE OF A SHIPPING INSERT OF A PRINTING DEVICE

FIELD OF THE INVENTION

The present disclosure relates to print quality. More particularly, the disclosure relates to detection of a shipping insert so that a user can be notified as to its presence and instructed to remove it.

BACKGROUND OF THE INVENTION

Toner-based printing devices, such as laser printers and photo copiers, normally include fusing systems that heat the toner to fuse it to the print media (e.g., paper). Such fusing systems typically comprise a fuser roller and a pressure roller that together form a nip through which print media pass. One or both of the rollers may be heated (either internally or externally) to provide the energy needed to fuse toner to the print media.

Often, the rollers of a fusing system are contained in a replaceable fusing unit such as that illustrated in FIGS. 1–3. As indicated in these figures, the fusing unit 100 can comprise an outer housing 102 in which the fuser roller 104 and the pressure roller 106 are disposed. One or both of the rollers 104, 106 may be provided with a resilient outer layer of material (e.g., a high-temperature polymeric material) that ensures good contact between the rollers so that a nip 108 may be formed between the rollers, as indicated in FIG. 3. In particular, one or more of the rollers 104, 106 is urged toward its opposing roller with a biasing mechanism that may include a biasing element, such as a spring 110, so that the resilient outer layer deforms at the contact point between the rollers to form the nip 108. With such a nip 108, good adhesion between the toner and the print media can be achieved, and the print media can be directed out from the fusing unit 100 through a slot 112 (FIG. 1) as a printed document.

Although the force provided by the biasing mechanism is necessary to achieve good fusing during printing, it can create permanent deformation of one or more of the rollers if the fusing system is not used for an extended period of time. For instance, if a given fusing unit 100 is not shipped to a customer for use for a relatively long period of time after its manufactured, permanent flats can be formed on one or more of the rollers that will adversely affect fusing.

To avoid permanent deformation of the rollers, fusing systems are often provided with a separation mechanism that decreases the force applied to one or more of the rollers. The separation mechanism may be a removable shim that is put into place before shipping and removed after shipping during the initial installation. This separation mechanism decreases pressure to eliminate a nip and prevent the roller from forming a permanent flat area. After the shim is removed, the appropriate pressure to create a nip will be applied.

In other arrangements, the separation mechanism may also be a lever which, may be placed in first position in which pressure is applied to the rollers and a nip is created, and may be placed in a second position in which pressure between the rollers is decreased and the nip is eliminated to prevent formation of a permanent flat area.

FIGS. 1–3 illustrate an example of such a mechanism. In this example, one more levers 114 can be provided that, as indicated in FIGS. 2 and 3, can be manipulated so as to reduce the force of the biasing mechanism (e.g., spring 110) applied to one or more of the rollers 104, 106. Specifically, the levers 114 can be toggled from a first position shown in FIG. 2 in which biasing force is reduced, to a second position shown in FIG. 3 in which the full biasing force is applied. With the provision of such a separation mechanism, the rollers 104, 106 are not urged together to the same degree as during normal operation to thereby avoid the formation of permanent flats on the rollers. In addition, the levers, where provided, can be used to separate the rollers when relatively thick print media (e.g., card stock, envelopes, etc.) are used.

Fusing quality will be reduced for most print media if firm contact is not made between the rollers of the fusing system. Shipping inserts may be provided along with the fuising system that serve as the shim itself or as a means to influence the user to place the rollers in firm contact with each other. For instance, as illustrated in FIG. 1, a shipping insert 116 can be attached to each lever 114 (only one insert illustrated in FIG. 1) that, when removed, automatically toggles the associated lever to the second position shown in FIG. 3. Such a shipping insert 116 may include a label 118 that comprises indicia that communicates the need to remove the shipping insert prior to use of the printing device.

Unfortunately, users occasionally do not properly use the separation mechanism. When a shim is used it may be left in place during the printing process. When a lever with a shipping insert attached is used, the customer may only remove the labels provided on the shipping inserts, as opposed to the entire inserts. For instance, such a user may merely cut the labels off from the shipping inserts with a scissors in thinking that the removal indication only pertains to the labels. In such a case, the separation mechanism may be left in a position such that the rollers are not urged together to the desired extent for most print media (e.g., the position shown in FIG. 2). If left in this orientation, adequate fusing will not be obtained except perhaps for relatively-thick print media. This, of course, leads to frustration for the user and unnecessary customer service requests.

From the foregoing, it can be appreciated that it would be desirable to have a system and method for detecting the presence of shipping inserts that, either directly or indirectly, cause separation of the fusing system rollers when not removed. With such detection, the user could be notified of this condition and instructed to remove the inserts.

SUMMARY OF THE INVENTION

The present disclosure relates to a system and method for detecting the presence of a shipping insert in a printing device. In one arrangement, the system and method pertain to determining if a print medium is detected at a fusing system exit of the printing device, and if a print medium is detected at the fusing system exit of the printing device, determining if a page count of the printing device is equal to zero, wherein if the page count is equal to zero it is confirmed that a shipping insert is present in the printing device.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Disclosed is a system and method for detecting the presence of a shipping insert in a fusing unit of a printing device. To facilitate description of the system and method, an example system is first discussed with reference to the figures. Although this system is described in detail, it will be appreciated that this system is provided for purposes of illustration only and that various modifications are feasible without departing from the inventive concepts. After the example system has been described, examples of operation of the system will be provided to explain the manners in which the presence of shipping inserts can be detected.

Figure 1:
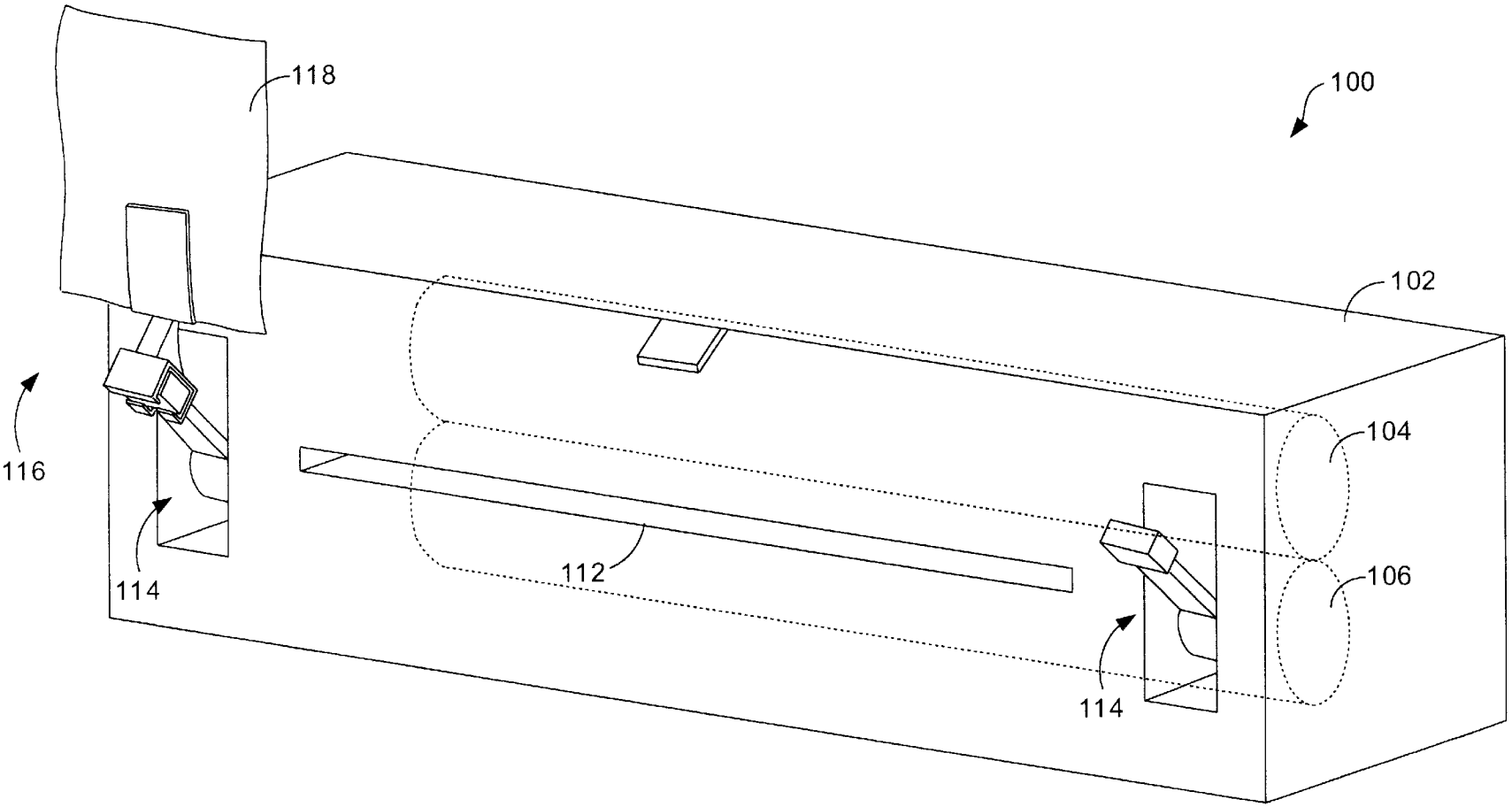
FIG. 1 (PRIOR ART)
FIG. 1 is a schematic perspective view of an example fusing unit of the prior art.
Figure 2:
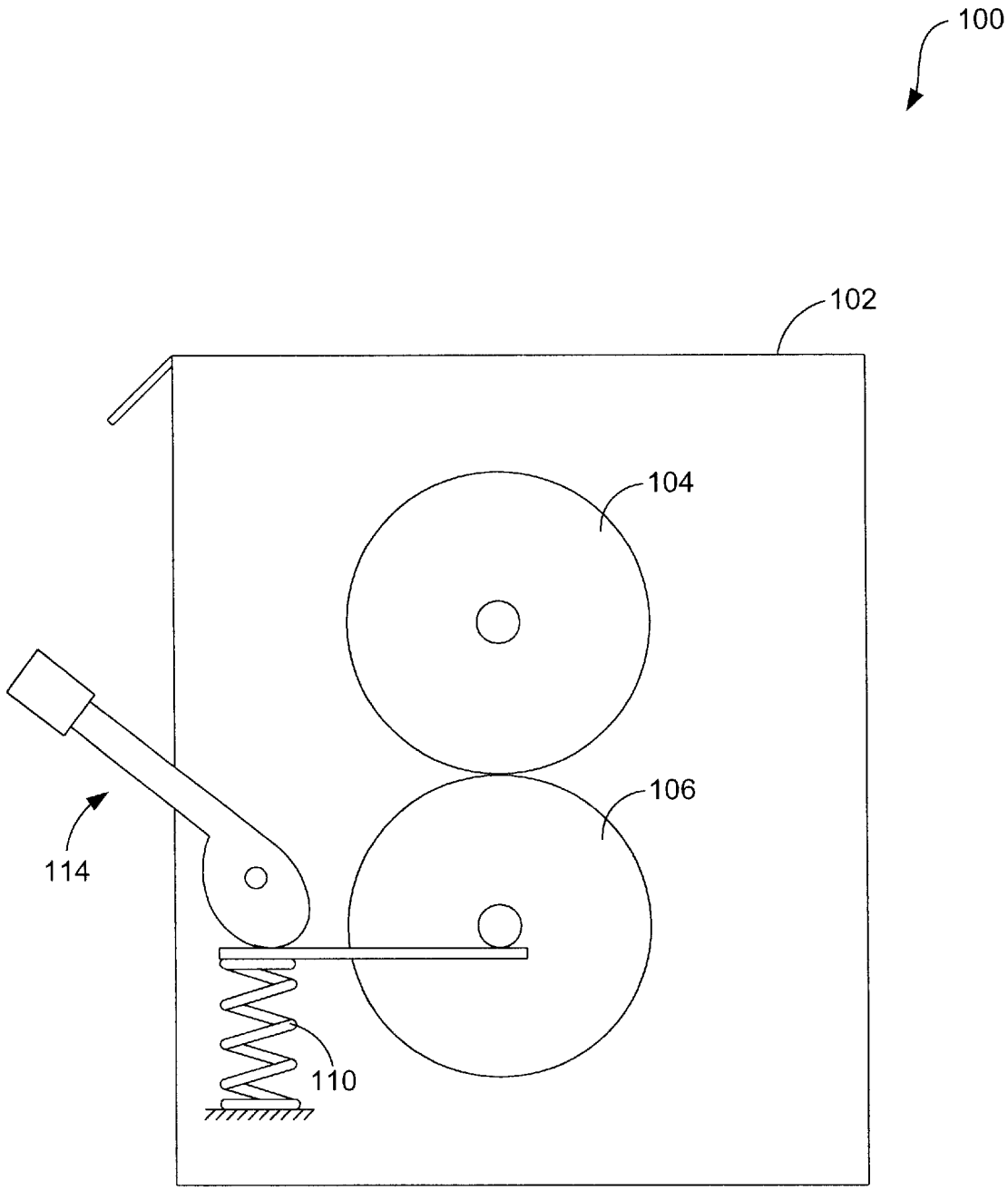
FIG. 2 (PRIOR ART)
FIG. 2 is a schematic side view of the fusing unit of FIG. 1, with a separation mechanism shown in a first position.
Figure 3:
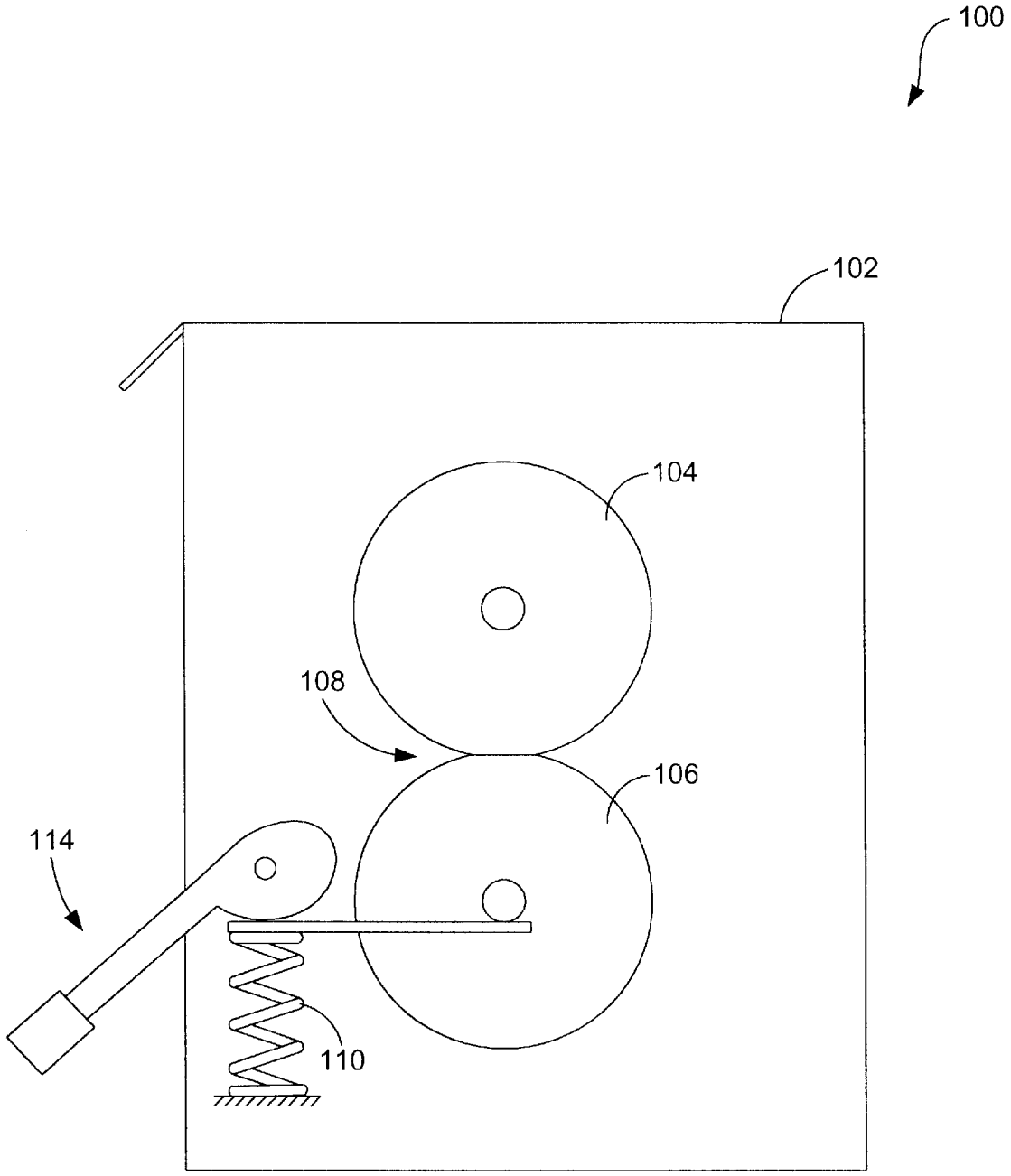
FIG. 3 (PRIOR ART)
FIG. 3 is a schematic side view of the fusing system of FIG. 1, with a separation mechanism shown in a second position.
Figure 4:
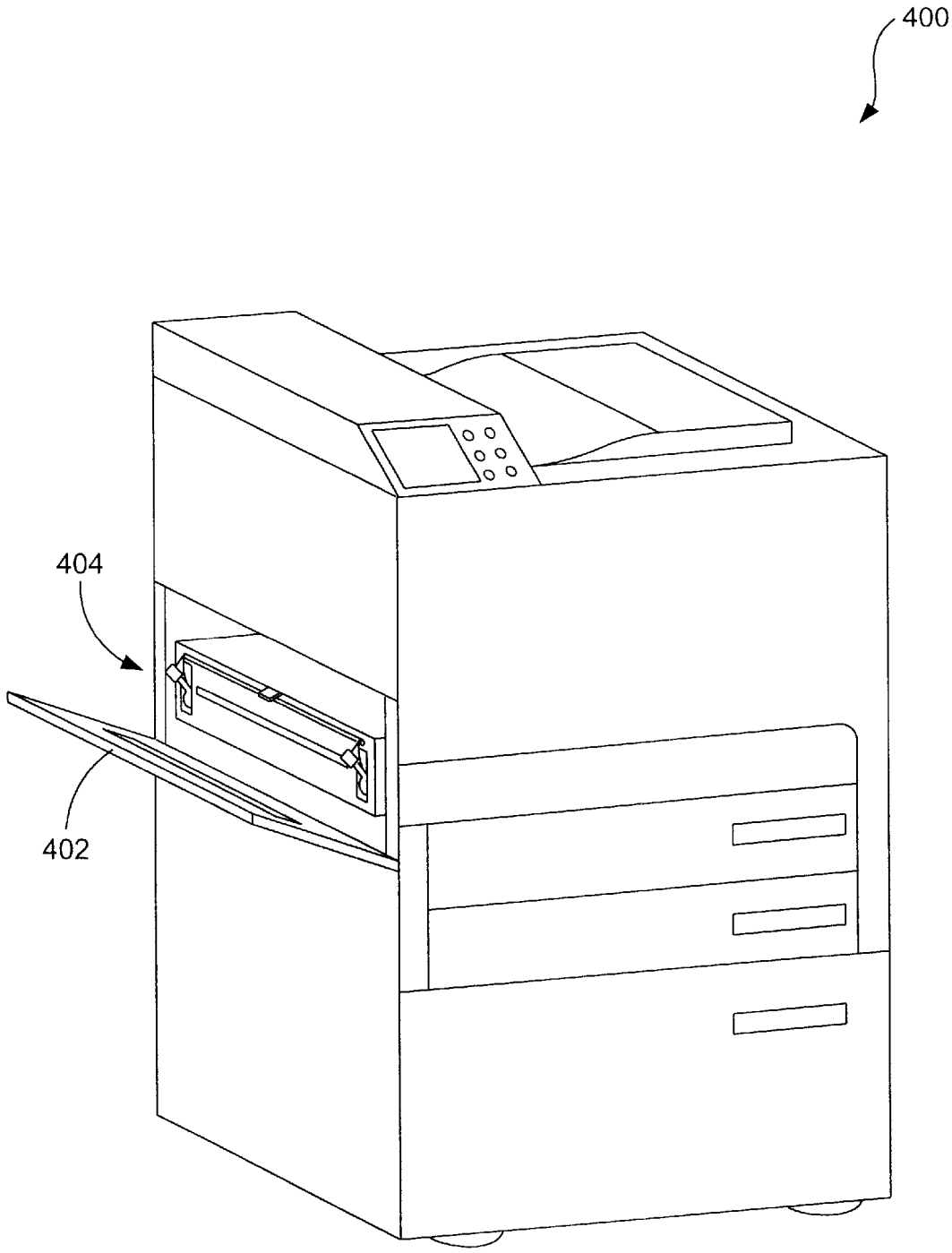
FIG. 4 is a printing device shown with a fusing unit that is configured to facilitate detection of the presence of shipping inserts.

Referring now in more detail to the drawings, in which like numerals indicate corresponding parts throughout the several views, FIG. 4 illustrates an example printing device 400. As indicated in this figure, the printing device 400 can be configured as a laser printer. Although a laser printer is illustrated in FIG. 4 and explicitly identified herein, it is to be understood that the present disclosure is pertinent to substantially any printing device that uses a fusing system of the general type including one or more rollers. For instance, the printing device could, alternatively, comprise a photocopier, a multifunction peripheral (MFP) device, an all-in-one device, etc.

As indicated in FIG. 4, the printing device 400 can be provided with a bay door 402 that provides access to an interior of the device in which a fusing unit 404 may be disposed. Through provision of this door 402, the fusing unit 404 can be serviced or replaced, as needed.

Figure 5:
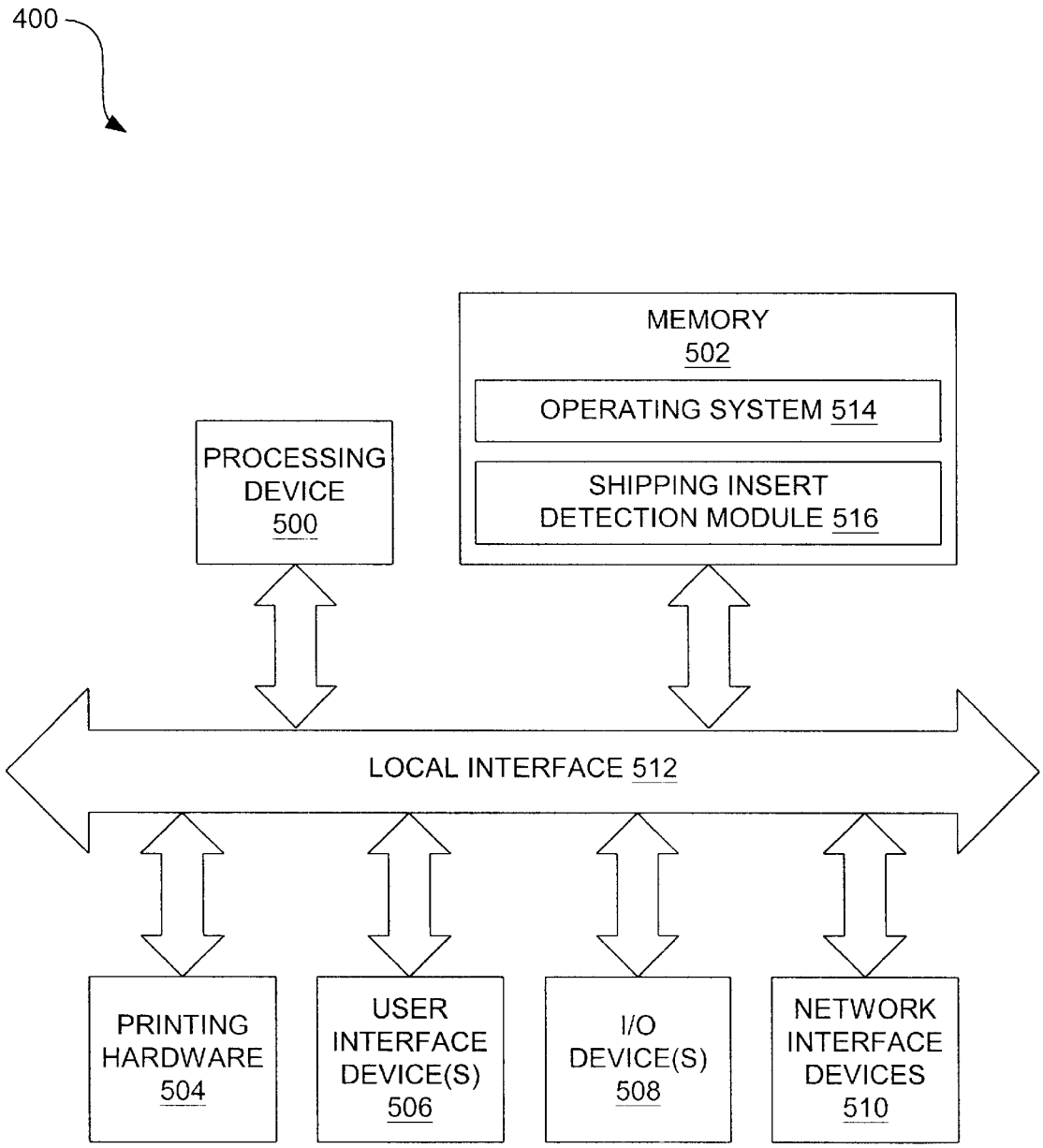
FIG. 5 is a block diagram of the printing device of FIG. 4.

Referring now to FIG. 5, illustrated is an example architecture for the printing device 400. As shown in this figure, the printing device 400 can, for instance, comprise a processing device 500, memory 502, printing hardware 504, one or more user interface devices 506, one or more input/output (I/O) devices 508, and one or more network interface devices 510. Each of these components is connected to a local interface 512 that, by way of example, comprises one or more internal buses. The processing device 500 is adapted to execute commands stored in memory 502 and can comprise a general-purpose processor, a microprocessor, one or more application-specific integrated circuits (ASICs), a plurality of suitably configured digital logic gates, and other well known electrical configurations comprised of discrete elements both individually and in various combinations to coordinate the overall operation of the printing device 400. The memory 502 can comprise any of a variety of memory elements including random access memory (RAM), one or more hard disks, read-only memory (ROM), etc.

The printing hardware 504 comprises the components with which the printing device 400 can generate hard copy documents. For example, the printing hardware 504 can comprise a print engine that is possible of many different configurations, as well as the fusing unit 404. The one or more user interface devices 506 typically comprise interface tools with which the device settings can be changed and through which the user can communicate commands to the printing device 400. By way of example, the user interface devices 506 comprise one or more function keys and/or buttons with which the operation of the printing device 400 can be controlled, and a display, such as a liquid crystal display (LCD), with which information can be visually communicated to the user and, where the display comprises a touch-sensitive screen, commands can be entered.

With further reference to FIG. 5, the one or more I/O devices 508 are adapted to facilitate connection of the printing device 400 and may therefore include one or more serial, parallel, small computer system interface (SCSI), universal serial bus (USB), IEEE 1394 (e.g., Firewire™), and/or personal area network (PAN) components. The one or more network interface devices 510, where provided, comprise the various components used to transmit and/or receive data over a network.

By way of example, the network interface devices 510 can include a device that communicates both inputs and outputs, for instance, a network card, modulator/demodulator (e.g., modem), wireless (e.g., radio frequency (RF)) transceiver, a telephonic interface, a bridge, a router, etc.

Stored within memory 502 is various software and/or firmware including an operating system 514 that contains the various commands used to control the general operation of the printing device 400. In addition, the memory 502 includes a shipping insert detection module 516 that, as its name suggests, is configured to facilitate detection of the presence of one or more shipping inserts that are to be removed. Operation of the module 516 is described below in greater detail with reference to FIG. 8. Although not indicated for purposes of brevity, it will be appreciated that the memory 502 may comprise various other software/firmware.

It is to be understood that the various software/firmware identified above can be stored on any computer-readable medium for use by or in connection with any computer-related system or method. In the context of this document, a computer-readable medium is an electronic, magnetic, optical, or other physical device or means that can contain or store a computer program for use by or in connection with a computer-related system or method. These programs can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. A "computer-readable medium" can be any means that can store, communicate, propagate, or transport the program for use by or in connection with the instruction execution system, apparatus, or device.

The computer-readable medium can be, for example but not limited to, an electronic, magnetic, optical, electromagnetic, infrared, or semiconductor system, apparatus, device, or propagation medium. More specific examples (a nonexhaustive list) of the computer-readable medium include an electrical connection having one or more wires, a portable computer diskette, a random access memory (RAM), a read-only memory (ROM), an erasable programmable read-only memory (EPROM, EEPROM, or Flash memory), an optical fiber, and a portable compact disc read-only memory (CDROM). Note that the computer-readable medium can even be paper or another suitable medium upon which a program is printed, as the program can be electronically captured, via for instance optical scanning of the paper or other medium, then compiled, interpreted or otherwise processed in a suitable manner if necessary, and then stored in a computer memory.

Figure 6:
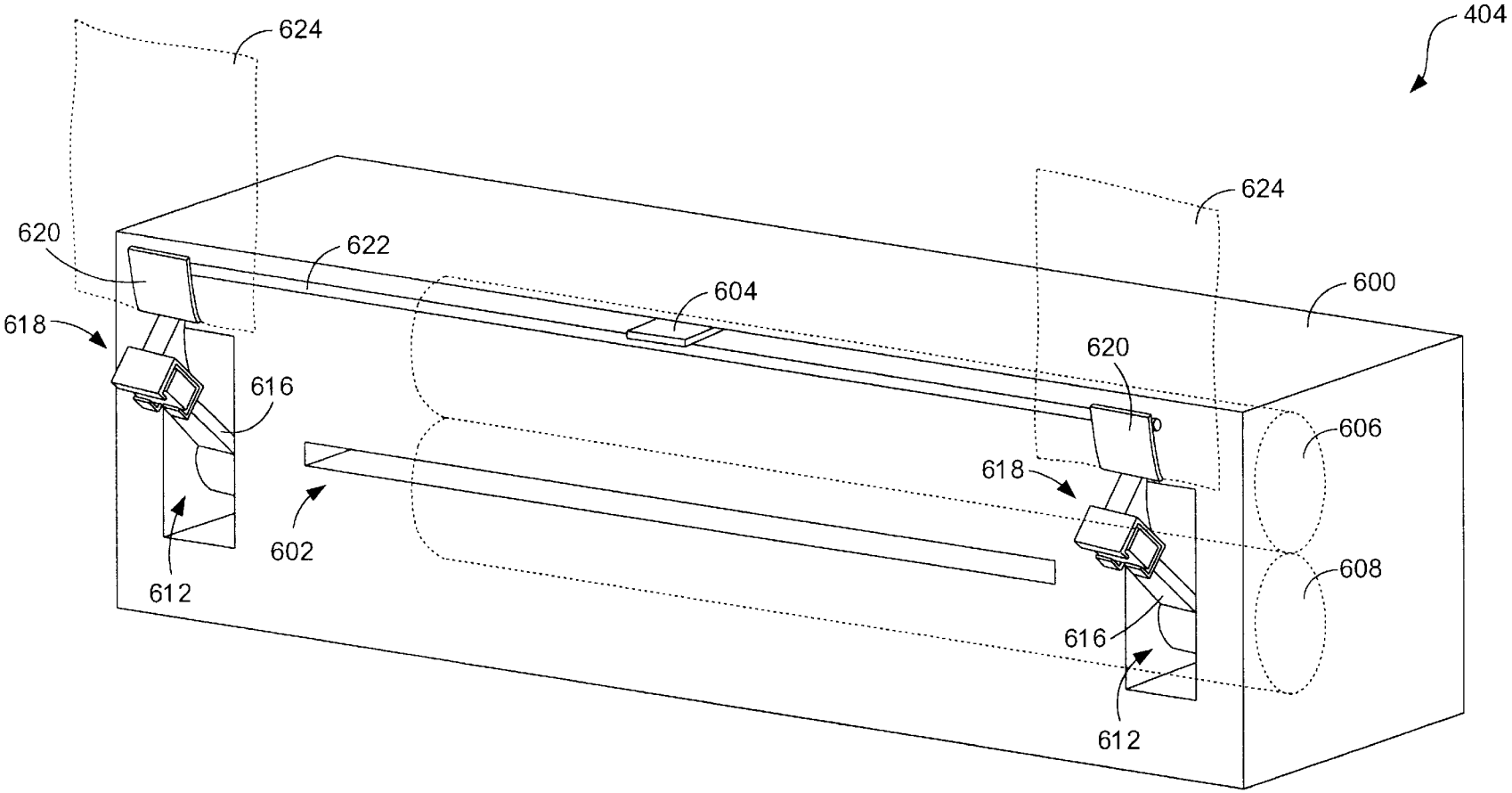
FIG. 6 is a schematic perspective view of a fusing unit shown in FIG. 4.
Figure 7:
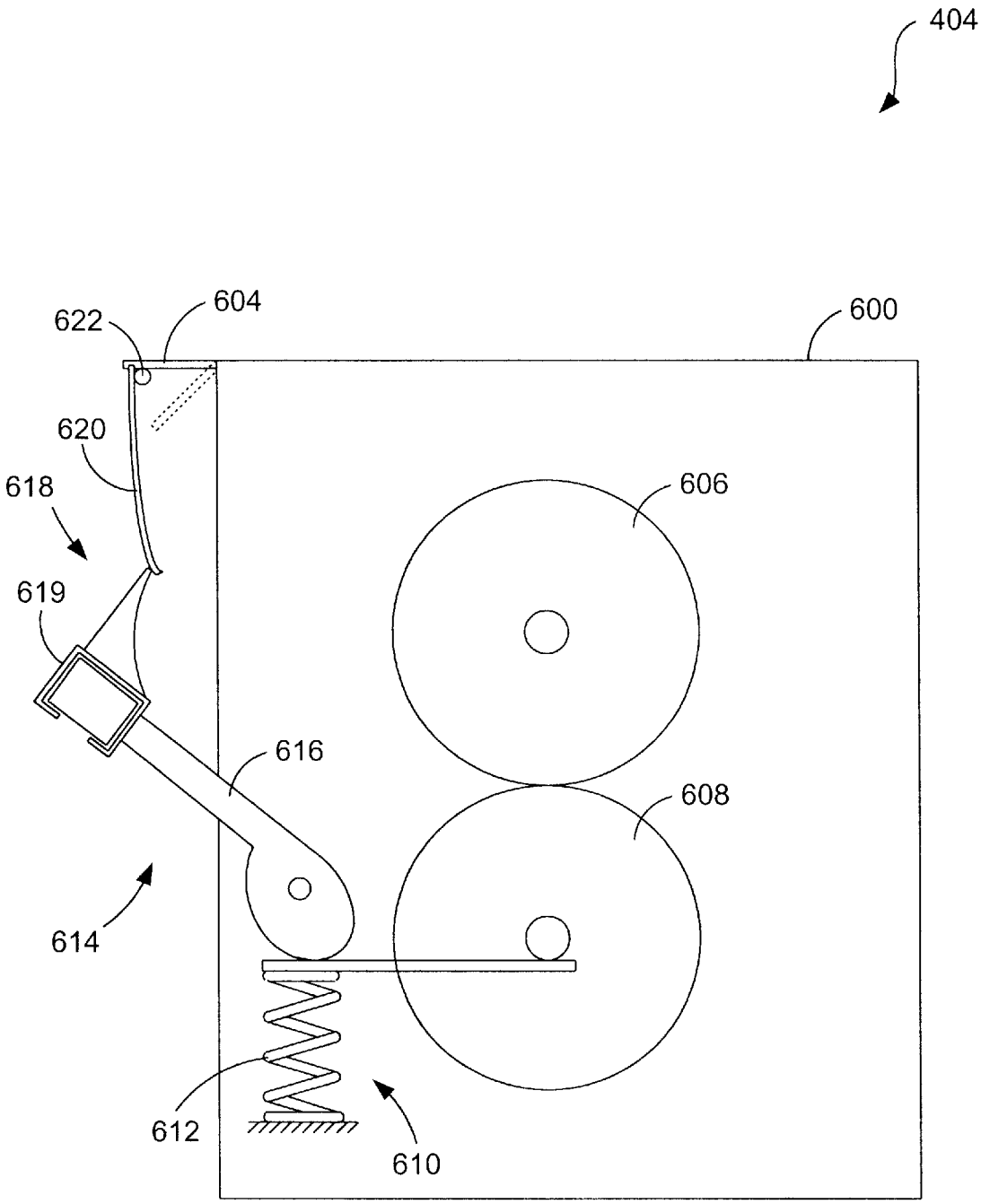
FIG. 7 is a schematic side view of the fusing unit of FIG. 6.

FIGS. 6 and 7 illustrate the fusing unit 404 shown in FIG. 4 in greater detail. As indicated in FIG. 6, the fusing unit 404 generally comprises a housing 600 through which print media pass. After print media pass between the fusing rollers, the leading edges of the media are guided upwards so as to engage a sensing element 604. The sensing element 604 is mounted to the housing to detect the presence of a print medium as is passes out of the fusing unit 404. By way of example, the sensing element 604 comprises a flag that can be toggled between two different positions, one indicating the presence of a print medium and the other indicating the absence of a print medium (FIG. 7). The position of the sensing element 604 can be determined with a switch (not shown) associated with the element or a photo detector (not shown) that is configured to detect one position of the element. As indicated in FIG. 6, the sensing element 604 can be positioned adjacent the top of the housing 600 in cases where the print media are moved upwardly along the print path after leaving the housing. It will be appreciated, however, that the sensing element could be placed in other positions depending upon the delivery of the print media from the fusing unit 404. The print media can be directed out from the fusing system 404 through a slot 602.

Disposed within the housing 600 is a fuser roller 606 and a pressure roller 608. As is identified in FIG. 7, the pressure roller 608 can be biased toward the fuser roller 606 with a biasing mechanism 610 that, for example, can include one or more springs 612. Although the pressure roller 608 is shown as being biased toward the fuser roller 606, it will be appreciated that the fuser roller could, alternatively, be biased toward the pressure roller or that both rollers could be biased toward each other.

The fusing unit 404 can include a separation mechanism 614 that, for instance, comprises one or more levers 616 that adjust the biasing mechanism 610. Although levers are depicted in FIGS. 6 and 7 and described herein, persons having ordinary skill in the art will appreciate that the separation mechanism could take one of many other possible forms. For instance, the separation mechanism could comprise one or more removable shims (not shown) that force the rollers 606, 608 apart against the force of the biasing mechanism 610. As will be apparent from the discussions that follow, the present system and method could also be employed in such other arrangements.

Attached to the levers 616 are shipping inserts 618 that can, for example, comprise brightly-colored polymeric elements that wrap around the end of the levers. The inserts 618 can, for example, comprise a body portion 619 (FIG. 7) that attaches to the levers 616 and tab portion 620 that extends outwardly from the body portion and to which is connected a sensing element contact member 622 that, for instance, extends between the tab portion of one insert to the tab portion of the other insert. Where only one shipping insert 618 is provided, the sensing element contact member 622 can merely extend laterally to the sensing element 604. As shown in both FIGS. 6 and 7, the sensing element contact member 622 supports the sensing element 604 such that the element is held in a first or upper position that, during use of the fusing unit 404, indicates the presence of a print medium. Optionally, labels 624 can also be connected to the tab portions 620 which include indicia (not shown) that instruct the user to remove the shipping inserts 618 before use of the fusing unit 404.

Figure 8:
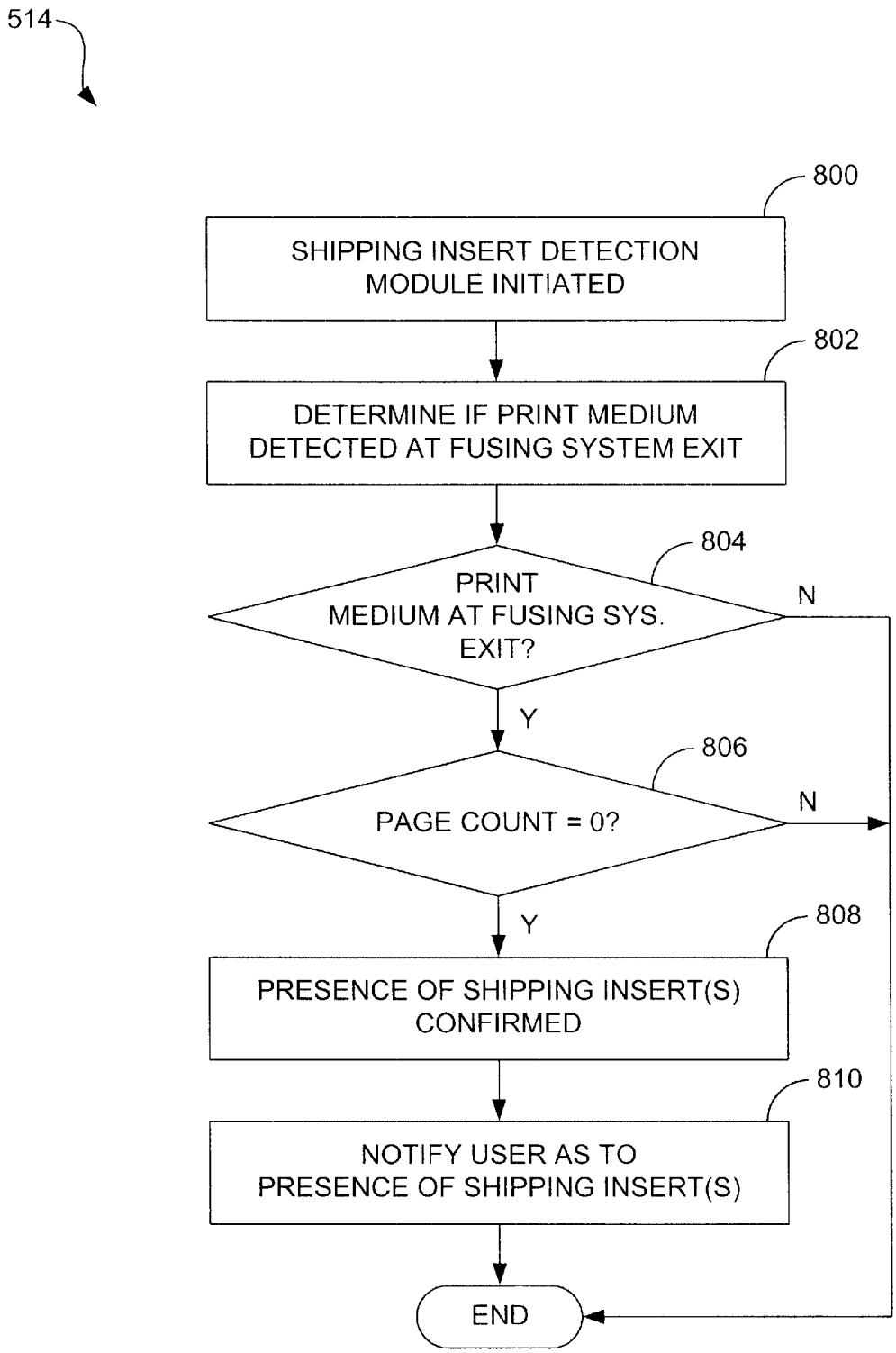
FIG. 8 is a flow diagram of an example method for detecting the presence of a shipping insert.

FIG. 8 shows an example of operation of the shipping insert detection module 514 as used to detect the presence of shipping insert(s) in a fusing system, such as fusing unit 404. Beginning with block 800, the shipping insert detection module 514 is first initiated. By way of example, this initiation occurs automatically when the printing device is powered. In such an arrangement, the module 514 is initiated when the printing device is first powered by a user.

Once the shipping insert detection module 514 is initiated, it determines whether a print medium is detected at the fusing system exit, as indicated in block 802. Where the fusing system is arranged as shown in FIGS. 6 and 7, this determination can be made in association with detection means that include the print medium sensing element 604. Where the fusing system is arranged as shown in FIGS. 6 and 7, the determination of print media in the fuser exit or not can be made in association with detection means that include the print medium sensing element 604. With reference to decision block 804, if a print medium is not determined to be at the fusing system exit, the shipping insert(s) have presumably been removed and flow for the module 514 is terminated. If, on the other hand, it is determined that a print medium is detected at the exist of the fusing system, flow continues to decision block 806 at which it is determined whether the print media count for the printing device is zero, indicating that no pages have yet been printed by the printing device. If the print media count is other than zero, the detection of print media at the fusing system exit is presumably correct and would indicated that printed media is jammed in the fuser exit, and flow for the module 514 is terminated. During printing, the unexpected present of print media at the exit of the fuser would indicated that the print medium was jammed in this area. However, if the print media count is zero indicating that no print media have been placed into the print path of the printing device, detection of a print medium at the fusing system exit is erroneous and, as indicated in block 808, the presence of one or more shipping inserts is confirmed. Where the fusing system is arranged as that shown in FIG. 6 and 7, this condition can occur in response to the sensing element contact member 622 in maintaining the sensing element 604 in the first or upper position shown in those figures.

If the presence of one or more shipping inserts is confirmed, the shipping insert detection module 514 can notify the user as to this condition, as indicated in block 810, and, optionally, instruct the user as to how to remove the shipping insert(s) so that optimal fusing can be provided by the fusing system of the printing device. By way of example, this information can be conveyed to the user with a display of the user interface device(s) 506. Once the user removes the shipping insert(s), normal operation of the printing device can be obtained and, as is apparent from FIG. 8, the shipping insert detection module 514 will no longer determine that the shipping insert(s) is/are present.

In view of the above, the present system and method provides a means to warn the user that shipping insert(s) of the printing device fusing system has/have not been removed and can provide instruction to the user to aid the user in properly removing the insert(s). Once the shipping insert(s) is/are removed, the fusing system will be placed into the proper configuration for fusing toner to typical print media (e.g., paper). By way of example, removal of the shipping insert(s) will toggle the separation mechanism to a position in which the fuser roller and the pressure roller are brought into full contact with each other so as to form a full nip. The fusing system will then function correctly, thereby maintaining user satisfaction and avoiding unnecessary customer support requests.

While particular embodiments of the invention have been disclosed in detail in the foregoing description and drawings for purposes of example, it will be understood by those skilled in the art that variations and modifications thereof can be made without departing from the scope of the invention as set forth in the following claims.

What is claimed is:

1. A method for detecting the presence of a shipping insert in a printing device, the method comprising:

determining if a print medium is detected at a fusing system exit of the printing device; and if a print medium is detected at the fusing system exit of the printing device, determining if a page count of the printing device is equal to zero;

wherein if the page count is equal to zero it is confirmed that a shipping insert is present in the printing device.

2. The method of claim 1, where in the step of determining if a print medium is detected comprises determining if a print medium is detected by detection means including a print medium sensing element.

3. The method of claim 2, wherein the print medium sensing element is a flag that is configured to be positioned in a first position that indicates the presence of a print medium and a second position that indicates absence of a print medium.

4. The method of claim 3, further comprising maintaining the flag in the first position with a sensing element contact member associated with a shipping insert so as to provide a means for signaling the presence of the shipping insert.

5. The method of claim 4, wherein the sensing element contact member comprises part of the shipping insert.

6. The method of claim 5, wherein the shipping insert attaches to a separation mechanism of the printing device fusing system.

7. The method of claim 6, wherein the shipping insert attaches to a lever of the separation mechanism.

8. A shipping insert detection module stored on a computer-readable medium, the module comprising:

logic configured to determine if a print medium is detected at a fusing system exit of a printing device;

logic configured to determine if a page count of the printing device is equal to zero if a print medium is determined to be detected; and logic configured to notify a user that a shipping insert has not been removed if a print medium is determined to be detected and the print count is equal to zero.

9. A shipping insert for a fusing system of a printing device, comprising:

a body portion that is adapted to attach to a separation mechanism of the fusing system; and a sensing element contact member that is adapted to maintain a print medium sensing element of the fusing system in a position that identifies the presence of a print medium.

10. The shipping insert of claim 9, wherein the body portion is formed as a clip.

11. The shipping insert of claim 10, wherein the body portion is adapted to clip to a lever of the separation mechanism.

12. The shipping insert of claim 9, further comprising a tab portion that extends outwardly from the body portion.

13. The shipping insert of claim 12, wherein the sensing element contact member extends laterally from the tab portion.

14. The shipping insert of claim 13, further comprising a label attached to the tab portion of the shipping insert that includes instructions as to removal of the shipping insert.

15. The shipping insert of claim 9, wherein the sensing element contact member supports the print medium sensing element in an upper position.

16. The shipping insert of claim 9, wherein the shipping insert is configured so as to toggle the separation mechanism from a first position to a second position when the shipping insert is removed.

17. A printing device, comprising:

a fusing system that includes a separation mechanism for separating a fuser roller and a pressure roller of the fusing system, the fusing system further including a print medium sensing element configured to facilitate detection of a print medium;

a shipping insert attached to the separation mechanism, the shipping insert being configured to maintain the sensing element in a first position that identifies the presence of a print medium and to toggle the separation mechanism to a second position in which the fuser roller and the pressure roller are fully urged against each other when the shipping insert is removed; and memory that comprises a shipping insert detection module that includes logic configured to determine if a print medium is detected at the fusing system and logic configured to determine if a page count of the printing device is equal to zero.

18. The printing device of claim 17, wherein the separation mechanism of the fusing system comprises a lever that is used to adjust the relative positions of the rollers.

19. The printing device of claim 17, wherein the shipping insert comprises a body portion that is adapted to attach to the separation mechanism of the fusing system and a sensing element contact member that is adapted to maintain the sensing element of the fusing system in a position that identifies the presence of a print medium.

20. The printing device of claim 17, wherein the shipping insert detection module further comprises logic configured to notify a user that a shipping insert has not been removed.

* * * * *